United States Patent [19]

Kishi et al.

[11] 3,943,777

[45] Mar. 16, 1976

[54] OPERATING APPARATUS FOR CIRCUIT BREAKER

[75] Inventors: Tuneo Kishi; Seizo Nakano, both of Hitachi, Japan

[73] Assignee: Hitachi, Ltd., Japan

[22] Filed: Aug. 14, 1974

[21] Appl. No.: 497,495

[30] Foreign Application Priority Data

Aug. 20, 1973 Japan ..... 48-92507

[52] U.S. Cl. ..... 74/2; 92/15; 92/23; 200/82 B

[51] Int. Cl.² ..... G05G 17/00

[58] Field of Search ..... 74/2; 200/82 R, 82 B; 92/15, 23

[56] References Cited

UNITED STATES PATENTS

| | | | |
|---|---|---|---|
| 2,342,816 | 2/1944 | Peek | 74/2 |
| 2,660,635 | 11/1953 | Wood | 74/2 X |
| 2,736,295 | 2/1956 | Peek | 200/82 B X |
| 3,334,202 | 8/1967 | Tognella | 200/82 B |
| 3,492,922 | 2/1970 | Van Sickle | 92/15 X |

*Primary Examiner*—Allan D. Herrmann

*Attorney, Agent, or Firm*—Craig & Antonelli

[57] ABSTRACT

A circuit breaker operating apparatus comprising an operating piston connected to an operating member for operating a breaking section, holding means for mechanically maintaining the operation-complete state of the operating piston at the time of completion of its operation, spring means for giving a restitutive force to the operating member, and means for releasing an operating medium acting on the operating piston at the time of completion of its operation. The holding means includes a first lever connected to the operating piston and a second lever having an end connected to the first lever and the other end adapted to be locked by lock means. The lock means is so simple as to be arranged at an optimum position.

5 Claims, 3 Drawing Figures

OPERATING APPARATUS FOR CIRCUIT BREAKER

BACKGROUND OF THE INVENTION

1. Field of the Invention

This invention relates to a circuit breaker operating apparatus, or more in particular to a circuit breaker operating apparatus suitable for high-speed operation of a large-capacity circuit breaker.

2. Description of the Prior Art

With the recent increase in the demand for electric power, there are more and more installations of high power transmission line circuit network, any breakdown of which is liable to lead to an extensive power failure. In order to minimize the effect of such an accident, the point of breakdown is required to be isolated from the rest of the circuit network immediately. This requires high-speed breaking operation of a circuit breaker provided in the network.

If the circuit breaker is required to operate at high speed, its operating apparatus must be also actuated at high speed.

A conventional high-speed circuit breaker has such an operating apparatus that an operating medium such as compressed air is used to obtain operating force for either breaking or closing operation, and the restitutive force of a spring stored during such an operation is utilized to derive force of other operation. For simplicity's sake, the description below assumes an arrangement in which the operating and closing forces are derived from an operating medium and a spring respectively. In an apparatus in which, after the operating medium acts on the operating piston connected to an operating member for operating the breaking section the circuit-broken condition is maintained by the operating medium, it is necessary to release the operating medium acting on the operating piston at the time of closing the circuit breaker, making it difficult to perform the closing operation at high speed. Further, in the event that the operating medium is reduced in pressure for some reason or other, the apparatus cannot maintain the circuit-broken condition and is liable to be undesirable closed state.

To improve this situation, another conventional circuit breaker operating apparatus has been proposed in which the circuit-broken state is maintained mechanically by holding means at the time when the breaking operation is completed and at the same time all the operating medium acting on the operating piston is exhaused so that the operating medium can not act to prevent the closing operation when the circuit breaker is closed next. This conventional apparatus makes possible a high-speed breaking and closing operation. However, the disadvantages of such improved conventional apparatus are in that the holding means for holding a large mechanical operating force is considerably bulky and hence the arrangement of such holding means at a position facilitating its own installation and inspection is difficult at the time of installation.

SUMMARY OF THE INVENTION

Generally, an object of the invention is to provide a circuit breaker operating apparatus capable of operating at high speed.

Specifically, an object of the invention is to provide a circuit breaker operating apparatus simple in construction.

Another object of the invention is to provide a circuit breaker operating apparatus capable of arrangement suitable for various types of circuit breakers, and especially, capable of being easily arranged in such a manner that the holding means for mechanically holding the circuit-broken state is easily assembled or dismantled.

According to one aspect of the invention, there is provided a circuit breaker operating apparatus comprising an operating piston connected to an operating member for operating a breaking section, admission valve means for supplying an operating medium to the operating piston, spring means in which restitutive force stored during the operation of the operating piston and which delivers the stored restitutive force to the operating member, means for releasing the operating medium acting on the operating piston upon completion of the operation of the operating piston, and holding means for mechanically holding the operation-complete state of the operating piston and releasing it at the time when said operating piston is restituted; the holding means including a first lever connected to a member which is in turn connected to the operating piston for rectilinear movement and a second lever having an end connected mechanically to the first lever and the other end locked by the holding device. This arrangement makes it possible to arrange the holding means at any appropriate position around the member in rectilinear motion, thereby facilitating the assemblage and dismantling of the holding means as well as high speed operation and simple construction.

DESCRIPTION OF THE PREFERRED EMBODIMENTS

Figure 1:
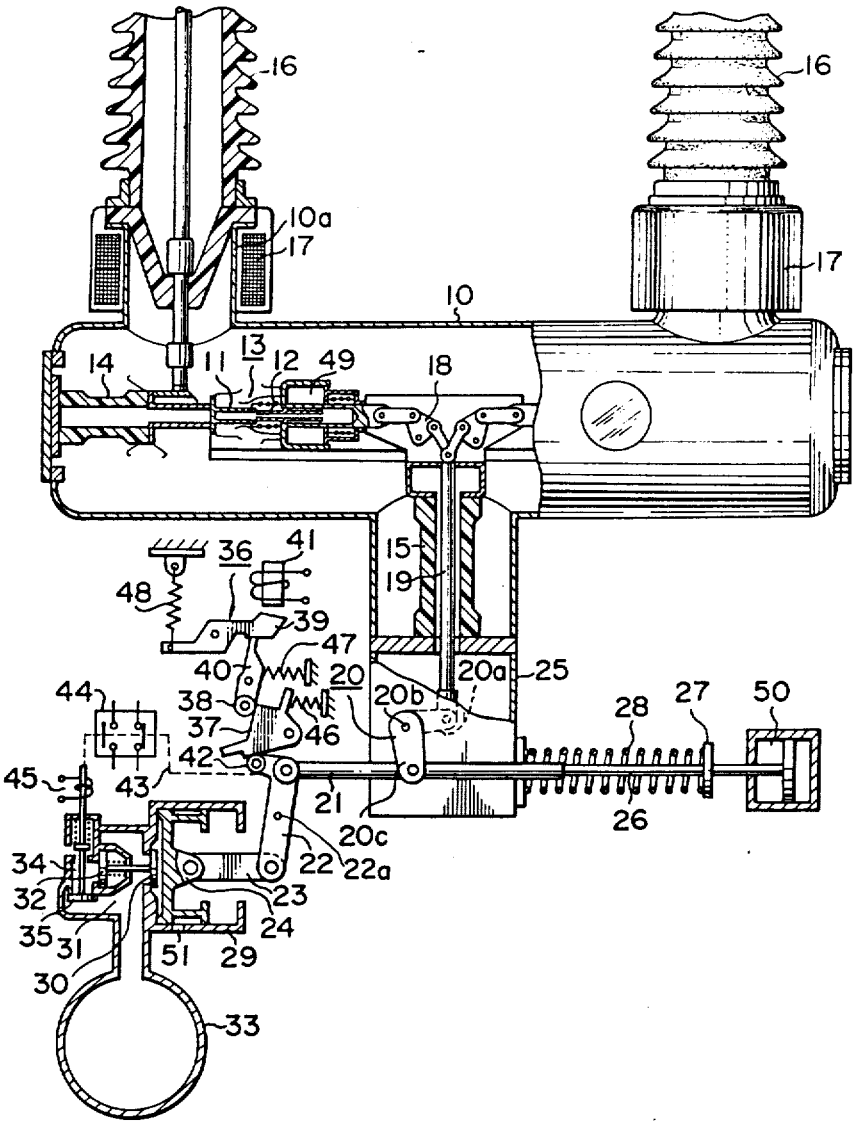
FIG. 1 is a sectional view showing an embodiment of a circuit breaker operating apparatus according to the invention when the circuit breaker thereof is in its closed state.

Referring to the accompanying drawings, a grounded tank 10 filled with an insulating gas such as $SF_6$ is provided therein with a breaker section 13 including a fixed contact member 11 and a movable contact member adapted to be attached to and to move away from the fixed contact member 11. The fixed contact member 11 and the movable contact member 12 are insulated from the grounded tank 10 by being supported on an insulating cylinder 14 and an insulating cylinder 15 respectively. A leadout section **10*a* is formed on the upper portion of the grounded tank 10, and a bushing 16 stands upright on the lead section 10*a*. Surrounding the lead-out section 10*a* is a current transformer 17 for detecting the current flowing through a central conductor. The movable contact member 12 is connected through link means 18 to an insulating rod 19 running through the insulating cylinder 15, the insulating rod 19 being connected through link means 20 to an operating member or rod 21. The operating rod 21 is connected to an operating piston 24 through a first lever 23 and a second lever 22. One lever 20*a* of the link means 20 is arranged in a case 25, while the other lever 20*c*** is arranged outside of the case 25. The respective levers 20*a* and 20*c* are connected by means of a rotary shaft 20*b* which is rotatably mounted through the wall of the case 25 in a complete air-tight manner. The other lever 20*c* of the link means 20 is pivotally connected to the operating rod 21 so that the link means 20 can rotate about the shaft 20*b* as the operating rod 21 moves. The contact force for maintaining the contact members 11 and 12 of the breaking section 13 in the closed state and the closing force for bringing the contact members 11 and 12 into the closed state are supplied by the restitutive force of a compression spring 28 interposed between the case 25 and a spring base 27 fixed on an operating rod 26 connected to the operating rod 21. Arrangement of the compression spring 28 is facilitated by positioning it on the opposite side of the operating rod 21 as viewed from the operating piston 24.

An operating cylinder 29 which slidably guides the operating piston 24 is provided with an admission valve 30 for supplying compressed air to the operating piston 24 therethrough. FIG. 1 shows the state in which the compressed air is prevented from being supplied to the operating piston 24 by the closed admission valve 30. A high pressure chamber 31 is formed on the opposite side of the admission valve 30 to the operating piston 24, and a control valve 32 is provided inside of the high pressure chamber 31 opposedly to the admission valve 30 so that compressed air acts on the control valve 32 in such a direction as to close the admission valve 30.

The high pressure chamber 31 communicates all the time with an air tank 33 filled with compressed air, and the admission valve 30 is closed by the control valve 32. On the opposite side to the high pressure chamber 31 with respect to the control valve 32, there is an air-supplying subchamber 34 which the compressed air is supplied to and exhausted from by the action of a pilot valve means 35.

On the other hand, the second lever 22 coupled with the operating rod 21 has an end adapted to engage a lock means 36, and is pivotally supported on a holding pin 22*a* substantially at the central portion thereof. The lock means 36 comprises a lock lever 37 for locking the second lever 22, a reset rod 40 with one end provided with a roller 38 running on the lock lever 37 and with the other end engaged with a hook 39, and electromagnetic means 41 for actuating the hook 39. The lever 22 has at an end thereof a roller 42 running on the lock lever 37. The reset rod 43 connected to an end of the lever 22 is connected to both an auxiliary switch 44 and another electromagnetic means 45. The lock lever 37 and reset rod 40 are so arranged as to be pressed in the counter-clockwise direction by compression springs 46 and 47, whereas the hook 39 is urged in the clockwise direction by a tension spring 48.

The breaking or tripping operation of the apparatus with the above-mentioned construction will be explained below.

When the electromagnetic means 45 is excited to render the pilot valve means 35 open, the compressed air is introduced into the air-supplying subchamber 34 thereby to increase the pressure therein. As a result, the control valve 32 is rendered open to thereby open the admission valve 30 to enable the compressed air to act on the operating piston 24 to urge the operating piston 24 in such a direction as to cut off the main current. Thus, the operating rod 21 is actuated through the first and second levers 23 and 22 to move to the left as viewed in FIG. 1. The actuation of the operating rod 21 causes the movable contact member 12, through the link means 20, the insulating operating rod 19 and the link means 18, to move away from the fixed contact member 11 to the right as viewed in FIG. 1. With the movement of the movable contact member 12 away from the fixed contact member 11, puffer means 49 compresses an arc extinguishing gas, and the resulting compressed arc extinguishing gas is blown against arcs formed between the contact members 11 and 12 thereby to extinguish it and cut off the current. In this process, the compression spring 28 stores its restitutive force when it is compressed by the spring base 27 as the operating rod 26 operated by the operating rod 21 is moved in the left side as viewed in FIG. 1. At the final stage of this circuit-breaking operation, the movement of the operating rod 26, and, therefore, of the operating piston 24 is restricted by a dash pot 50.

Figure 2:
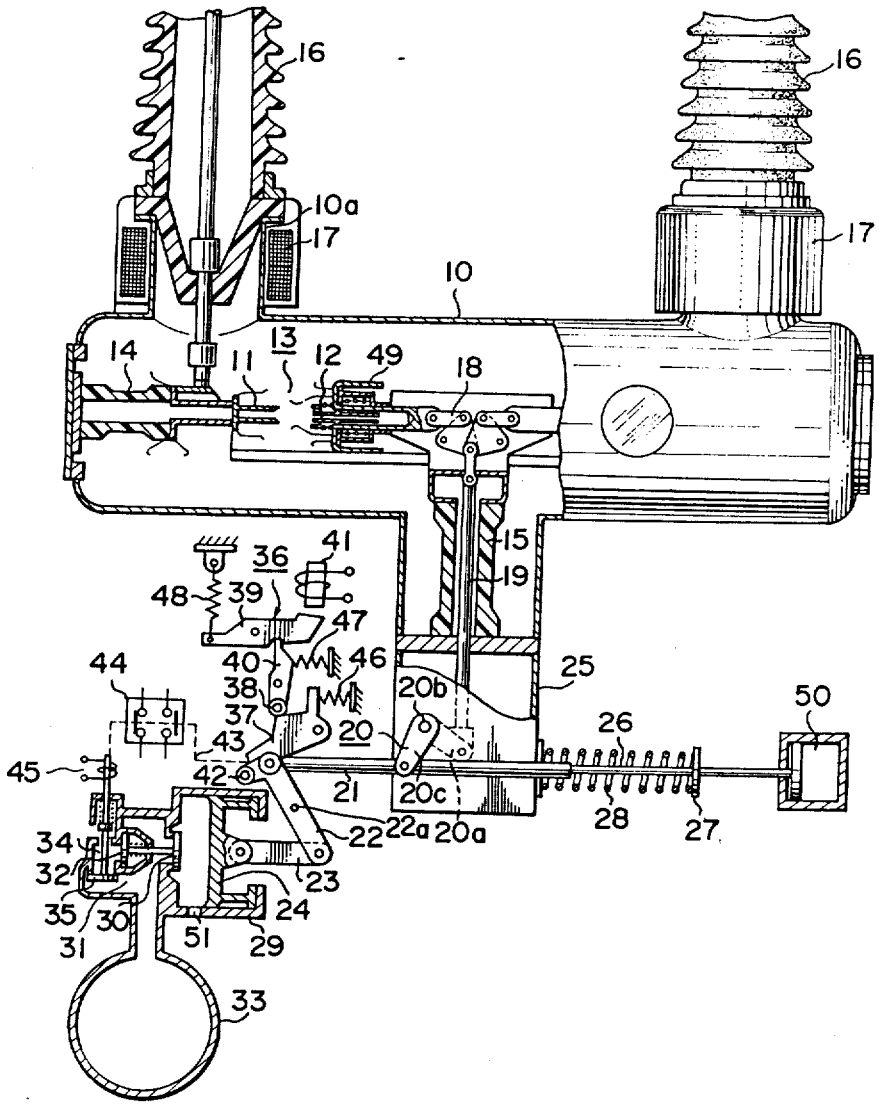
FIG. 2 is a sectional view showing the same operating apparatus when the circuit breaker is in its broken state.

During the circuit-breaking cycle, the roller 42 provided at the end of the second lever 22 moves left along the lock lever 37, so that at the end of the circuit-breaking cycle the lock lever 37 engages the lever 22 in a lock state and further permits the reset rod 40 to be locked by the hook 39 as shown in FIG. 2. Further, the auxiliary switch 44 and the pilot valve means 35 are energized through the reset pilot 43 so that the broken condition of the circuit is detected through the auxiliary switch 44 and the compressed air acting on the control valve 32 stops being introduced into the air-supplying subchamber 34, respectively, while at the same time exhausting the compressed air from the air-supplying subchamber 34. As a result, the admission valve 30 is closed by the compressed air acting on the control valve 32 from the side of the high-pressure chamber 31 or right side of the valve 32 as viewed in FIG. 1, thereby stopping supply of the compressed air to the operating piston 24. At the same time, the compressed air is exhausted out of the operating cyclinder 29 through an exhaust hole 51 thereby to eliminate the pressure thus far applied to the operating piston 24. But, the broken state of the circuit is maintained mechanically by the lock means 36.

Next, the circuit-closing operation will be explained. When the electromagnetic means 41 is excited, the hook 39 is urged upwards. The fact that the end of the second lever 22 is urged right by the restitutive force of the compression spring 28 causes the lock lever 37 and reset rod lever to be rotated clockwise, thereby disengaging the end of the lever 22 from the lock lever 37.

As a result, the operating rod 21 is urged right by the restitutive force of the compression spring 13 thereby to close the circuit by driving the movable contact member 12 of the breaking section 13 through the link device 20 and the insulating operating rod 19. At the same time, the operating piston 24 is driven by the compression spring 28 to move left because of the absence of compressed air acting thereon to make possible a high-speed circuit closing process without working against the circuit closing force.

In the above-described apparatus, the second and first levers 23 and 22 constitute part of holding means for mechanically holding the circuit-broken state of the circuit-breaker as well as function as part of link means for transmitting the operating force from the operating piston 24 to the breaking section, thus minimizing the number of required component elements.

The link means and the holding means, if arranged to operate in the same plane as in the preceding embodiment, will give rise to difficulties in space utilization, assembly work and inspection.

Figure 3:
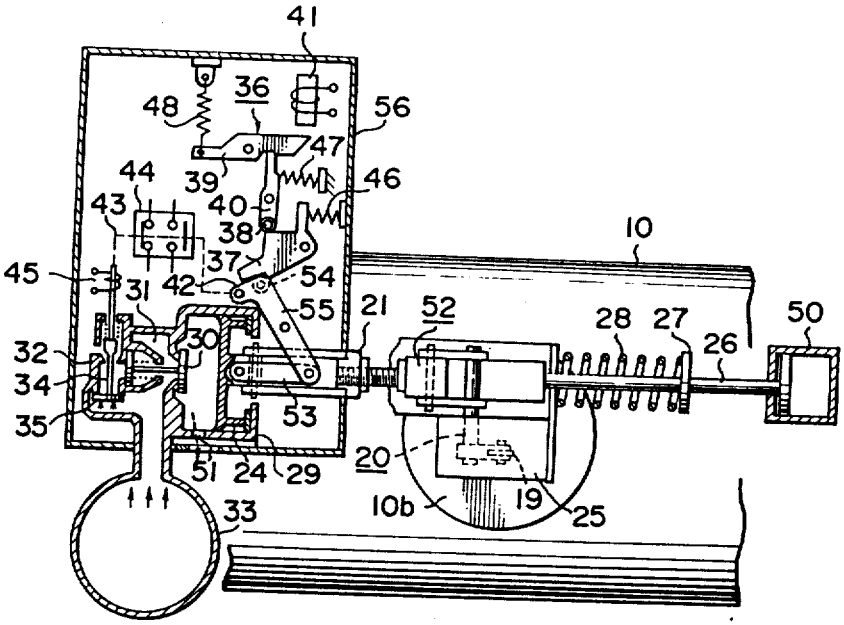
FIG. 3 is a sectional view showing another embodiment of the circuit breaker operating apparatus according to the present invention.

Such difficulties are overcome by the embodiment described below with reference to FIG. 3. In FIG. 3, those components which are identical to those shown in FIG. 1 and FIG. 2 are given the same identifying numerals as were used in FIGS. 1 and 2.

It will be seen that a grounded tank 10 containing a breaking section and being filled with an insulating gas is arranged in parallel to the operating means and has a protrusion 10*b* which contains an insulating operating rod 19 connected to a link means 20. The link mechanism 52 comprising an operating rod 21, the link means 20 and the insulating operating rod 19 for transmitting an operating force from an operating piston 24 to the breaking section (not shown) operates in a plane perpendicular to the sheet of the drawing. Apart from the link mechanism 52 for transmitting the operating force to the breaking section, the operating piston 24 is coupled with a first lever 53 which is in turn coupled with a second lever 55 having an end coupled to the first lever 53 and the other end provided with a roller 54 adapted to be locked by a lock lever 37 of lock means 36. Thus, at the time point when the operating piston 24 has completed its circuit-breaking operation, the roller 54 of the second lever 55 is locked by the lock lever 37 thereby to mechanically maintain the circuit-broken state. The embodiment under consideration is arranged in such a way that the link mechanism 52 for transmitting the operating force to the breaking section operates in a plane perpendicular to the operating plane of the lock means 36. This arrangement permits holding means including the first and second levers 53 and 55 and the lock means 36 and provided in a housing 56 to be easily assembled and inspected from the side of the housing 56. Also, in view of the fact that the first lever 53 is connected to the operating piston 24 always adapted for rectilinear motion, arrangement of relative positions of the links of the holding means is easily designed. Instead of the first lever 53 directly coupled with the operating piston 24 as in the case of FIG. 3, the first lever 53 may alternatively be coupled with a member coupled to the operating piston 24 for rectilinear motion.

This arrangement in which, in addition to the link mechanism 52 for transmitting the operating force to the breaking section, the first and second levers 53 and 55 are connected to the operating piston 24 or to a member connected to the operating piston 24 for rectilinear motion makes it possible for the link mechanism 52 to operate not only in the plane perpendicular to the operating plane of the holding means but at any desired angle thereto without changing the link ratio of the holding means, with the result that the holding means can be disposed at an optimum position taking into consideration the ease with which the apparatus is assembled and inspected as well as the space utilization.

It goes without saying that unlike the above-described embodiments in which the circuit-breaking force is derived from the operating medium and the circuit-closing force from the tension of a spring, the invention is applicable with equal effect to the case in which the circuit-breaking and circuit-closing force are derived from the spring tension and operating medium respectively.

As will be seen from the foregoing description, the apparatus according to the invention comprises an operating piston coupled to an operating member or rod for operating the breaking section, admission valve means for supplying an operating medium to the operating piston, spring means which stores restitutive force during the operation of the operating piston and delivers it to the operating member, means for releasing the force applied by the operating medium to the operating piston at the time of completion of the piston operation, and the holding means including the first lever connected to the member coupled to the operating piston for rectilinear motion and the second lever having an end connected mechanically to the first lever and the other end adapted to be locked by the lock means, so that the operation-complete state of the operating piston is mechanically maintained and is released when the operating piston is restituted. Thus, it is possible to provide a circuit breaker operating apparatus which is capable of operating at high speed and has holding means being simple in construction and being arranged at a most suitable position.

We claim:

1. A circuit breaker operating apparatus comprising: an operating piston connected to an operating member for operating a breaking section; admission valve means for supplying an operating medium to said operating piston; spring means in which restitutive force is stored during the operation of said operating piston and which delivers the stored restitutive force to said operating member; means for releasing said operating medium acting on said operating piston upon completion of the operation of said operating piston; and holding means including a first lever connected to said operating piston for rectilinear motion and a second lever having an end adapted to be locked by lock means and the other end mechanically coupled to said first lever; said holding means mechanically maintaining the operation-complete state of said operating piston and releasing said state at the time when said operating piston is restituted.

2. A circuit breaker operating apparatus according to claim 1, in which said first lever is directly coupled to said operating piston.

3. A circuit breaker operating apparatus according to claim 1, in which said operating piston and said operating member are connected through said first and second levers.

4. A circuit breaker operating apparatus according to claim 1, in which said lock means comprises a lock lever for locking said second lever, a reset rod for restricting the operation of said lock lever, and a hook for restricting the operation of said reset rod, said hook releasing said reset rod by being energized by electromagnetic means.

5. A circuit breaker operating apparatus according to claim 1, in which said spring means and said operating piston are disposed on opposite sides of link means provided on the middle portion of said operating member for operating said breaking section, said link means changing the direction of operation of said operating member by 90°.

* * * * *